US011619084B2

(12) United States Patent
Kienzler et al.

(10) Patent No.: US 11,619,084 B2
(45) Date of Patent: Apr. 4, 2023

(54) FRICTION HINGE

(71) Applicant: Otto Ganter GmbH & Co. KG Normteilefabrik, Furtwangen (DE)

(72) Inventors: Rudolf Kienzler, Furtwangen (DE); Patrick Rombach, Furtwangen (DE)

(73) Assignee: OTTO GANTER GMBH & CO. KG NORMTEILEFABRIK, Furtwangen (DE)

( * ) Notice: Subject to any disclaimer, the term of this patent is extended or adjusted under 35 U.S.C. 154(b) by 0 days.

(21) Appl. No.: 17/487,228

(22) Filed: Sep. 28, 2021

(65) Prior Publication Data

US 2022/0106821 A1 Apr. 7, 2022

(30) Foreign Application Priority Data

Oct. 7, 2020 (DE) ..... 10 2020 126 201.9

(51) Int. Cl.
*E05F 1/14* (2006.01)
*E05D 11/08* (2006.01)

(52) U.S. Cl.
CPC ..... *E05D 11/084* (2013.01); *E05Y 2900/606* (2013.01)

(58) Field of Classification Search
CPC ..... Y10T 16/5403; Y10T 16/54038; G06F 1/1681; G06F 1/1616; E05Y 2900/606; E05Y 2201/26; H04M 1/0216; E05D 11/08; E05D 11/082; E05D 11/084; E05D 11/085; E05D 3/02; E05D 5/14; E05D 2005/145; F16C 11/04
See application file for complete search history.

(56) References Cited

U.S. PATENT DOCUMENTS 5,037,231 A * 8/1991 Kitamura ..... F16C 11/10 403/111
5,195,213 A * 3/1993 Ohgami ..... G06F 1/1616 361/825
5,211,368 A * 5/1993 Kitamura ..... G06F 1/1681 16/337
5,354,028 A * 10/1994 Kitamura ..... G06F 1/1616 16/342
5,394,913 A * 3/1995 Zezza, Jr. ..... A45C 13/005 16/385
5,464,083 A * 11/1995 Arnold ..... G06F 1/1681 16/337

(Continued)

FOREIGN PATENT DOCUMENTS

DE 690 06 643 T2 7/1994
DE 691 16 545 T2 9/1996

(Continued)

*Primary Examiner* — Chuck Y Mah
(74) *Attorney, Agent, or Firm* — Browdy and Neimark, PLLC

(57) ABSTRACT

Friction hinge (21) for the pivotable connection of two components, comprising at least one first hinge sleeve (24) which is arranged in alignment with at least one further hinge sleeve (22), a shaft (11) which runs through the hinge sleeves (22, 24), and at least one friction spring for exerting a friction torque on the movable shaft (11), wherein at least two mutually aligned friction springs (10, 10') are connected to the first hinge sleeve (24) via radial shoulders (16, 16') and exert a friction torque on the shaft (11) mounted in the further hinge sleeve (22).

14 Claims, 5 Drawing Sheets

(56) References Cited

U.S. PATENT DOCUMENTS

Figure 1:
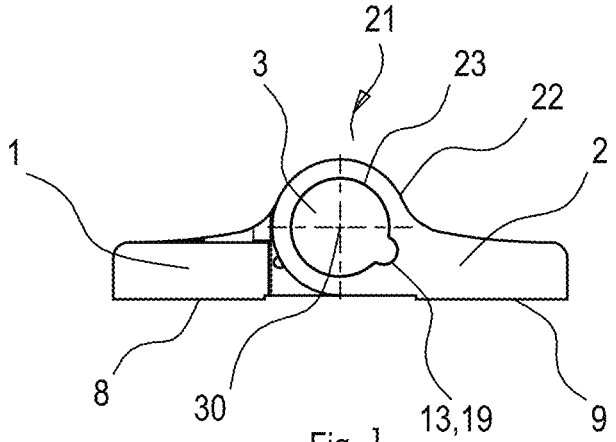

| | | | | |
|---|---|---|---|---|
| 5,771,539 | A | 6/1998 | Wahlstedt et al. | |
| 5,950,281 | A | 9/1999 | Lu | |
| 6,871,383 | B2 | 3/2005 | Huang | |
| 2002/0162191 | A1* | 11/2002 | Chen | G06F 1/1681 16/337 |
| 2008/0141495 | A1* | 6/2008 | Fisher | A63H 33/008 16/343 |
| 2010/0281653 | A1 | 11/2010 | Lin | |
| 2011/0239408 | A1* | 10/2011 | Chang | G06F 1/1681 16/386 |
| 2012/0102675 | A1* | 5/2012 | Lee | G06F 1/1681 16/243 |
| 2012/0205368 | A1* | 8/2012 | Lin | G06F 1/1681 16/297 |
| 2014/0059805 | A1* | 3/2014 | Krahn | G06F 1/1681 16/342 |
| 2014/0173852 | A1 | 6/2014 | Heninger | |
| 2019/0040665 | A1 | 2/2019 | Jean et al. | |

FOREIGN PATENT DOCUMENTS

| | | | |
|---|---|---|---|
| DE | 10 2004 043 899 | A1 | 3/2006 |
| EP | 1 454 558 | A1 | 9/2004 |

* cited by examiner

FRICTION HINGE

The subject of the invention is a friction hinge for the pivotable connection of two components, comprising at least one first hinge sleeve which is arranged in alignment with at least one further hinge sleeve, a shaft which runs through the hinge sleeves, and at least one friction spring for exerting a friction torque on the movable shaft.

Such friction hinges are used for window sashes, doors, on vehicles, for example for vehicle doors or hoods, on machines or for other purposes. The hinges are designed in such a way that they ensure good guidance of the pivotable part carried by them and ensure sufficient friction to hold a cover at any angle, for example. For this purpose, a frictional torque is generated by the rotation of the two hinge leaves of the hinge relative to one another in order to provide the necessary friction.

The frictional torque is a torque that occurs on the shaft of the hinge and describes the kinetic friction between solid bodies. During the movement of the two hinge leaves to one another, i.e. at a speed other than zero, this torque acts against the direction of movement.

To generate the frictional torque, so-called friction springs are used, which are placed around a cylindrical shaft and clamp it in order to generate friction.

U.S. Pat. No. 5,771,539 A shows a torsion hinge for generating a frictional torque, which torsion hinge is not designed as a friction hinge of the generic type. The hinge comprises a shaft and a single helical element which is wrapped around the shaft with a friction fit. The element has a first end that is coupled to a first joint element and a second end that is coupled to a second joint element. When the first joint element moves relative to the second joint element, the spiral-shaped element generates a frictional torque on the surface of the shaft and thus a torque between the two joint elements.

The disadvantage of this device, however, is that slip can always occur between the belt and the shaft clamped therein.

DE 691 16 545 T2 shows a friction hinge for pivotably connecting two components, comprising a movable hinge sleeve which is arranged between two fixed hinge sleeves and a shaft which runs through all the hinge sleeves. A band-shaped spring is loosely wound around the shaft, on the protruding end of which a resilient element acts upon to tighten the band when the two hinge leaves are pivoted against each other, thus exerting a frictional torque on the shaft.

A disadvantage of this friction hinge, however, is the excessive clearance that exists between the movable parts, which means that the frictional torque cannot be precisely dimensioned.

The invention is therefore based on the object of developing a hinge of the type mentioned at the outset in such a way that a simplified design of the hinge is possible, taking into account the most precise possible dimensioning of the frictional torque.

The object is achieved according to the invention by the features of the independent claim, while advantageous configurations and developments of the invention can be found in the dependent claims.

A first preferred embodiment provides that at least two friction springs aligned with one another are connected to the first hinge sleeve in a rotationally fixed manner via radial shoulders, the first hinge sleeve advantageously being mounted between at least two stationary hinge sleeves, the friction springs applying a friction torque to the shaft which is rotatably mounted in the other hinge sleeves.

In another preferred embodiment, it is provided, however, that the hinge consists of only two hinge halves with one half taking over the fixed side and the other the loose side. Thus, a kind of detachable hinge would be obtained.

It is particularly advantageous that the at least two friction springs do not have any mutual coupling and act as a spring assembly connected in parallel. They are therefore lined up one behind the other on the shaft and each friction spring acts on its own. They can therefore be easily exchanged and the frictional force of the spring package can be adjusted by adding further friction springs. The parallel coupling of the friction springs takes place through the engagement of the respective spring end in the common longitudinal groove of the first hinge sleeve.

A single friction spring consists of a bent spring wire with at least one and a maximum of 5 turns, two turns being preferred. Tests have shown that, starting from turns, the "constricting" effect no longer occurs to a significant extent. In an alternative embodiment, the friction spring can also have more than two turns. Such a spring wire can be a round wire or a wire with an angular, for example square, cross section or else have a completely different design.

The friction spring is bent in such a way that a circular opening is created through which the shaft is guided. The friction spring rests with its friction surfaces, which form the contact surface within the openings, on the shaft or on the outer circumference of the shaft. Depending on the cross-sectional shape of the spring wire, there is only a small contact area with a round cross section, the friction surfaces resting tangentially on the shaft, while in the case of a square cross section, there is a large contact region and the friction surfaces are flat. The friction surfaces engage with a friction fit in the surface of the shaft and generate a frictional torque when the one hinge leaf that is coupled to the friction springs is rotated relative to the shaft.

The circularly bent friction spring has a shoulder made of one piece of material, which extends outward in the radial direction and represents the end of the spring wire. The shoulder thus extends in one plane away from the shaft and—in this preferred example—is preferably mounted free of clearance in a longitudinal groove in the hinge sleeve. The shoulder is received in a longitudinal groove of the hinge sleeve, with which the friction spring is coupled to the hinge sleeve and the movements of the sleeve are transmitted to the spring. It is therefore a concealed installation of the at least two friction springs in the interior space of the hinge sleeve, which has the advantage of precise guidance of the friction springs and protection against contamination.

In another embodiment, the springs can also be installed openly so as to be visible from the outside. In this open version, the individual springs are also visible. Such an embodiment has the advantage of easy assembly and the possibility of checking the function of the springs.

The longitudinal groove extends in the longitudinal direction of the hinge sleeve and is made in the inner circumferential surface of the interior space.

For optimal generation of the frictional torque, it is necessary that at least one end of the friction spring, hereinafter referred to as the shoulder, is clamped, the greatest frictional torque being generated in the direction of rotation in which the friction spring tends to tighten around the shaft, i.e. when the opening of the friction spring, which surrounds the shaft, becomes smaller and smaller. By generating the friction in this way, it is possible to maintain a specific angular position of the hinge. This creates a locking force that blocks the hinge.

In this first embodiment, it is provided that the friction spring is only supported with the first radial spring end on the longitudinal groove of the hinge sleeve designed as a stop surface and that the second spring end abuts against the shaft with a friction fit and without a stop and is carried along by the shaft.

In a second embodiment, it is provided that the friction spring is also supported with a first radial spring end on the longitudinal groove of the hinge sleeve designed as a stop surface, and that the second spring end abuts against the shaft with a stop and is carried along by the shaft.

The friction hinge preferably has two symmetrical hinge leaves, one hinge leaf being fastened to a stationary surface while the other hinge leaf is fastened to a surface that is movable relative thereto.

The shaft has a transverse groove at its front and rear ends. This transverse groove is a recess running in the longitudinal direction starting from the front side of the shaft and which is milled or sawn into the front and rear ends of the shaft.

The shaft is covered at the front side by a sleeve-shaped end piece which surrounds the transverse groove and which is inserted into the interior space of the hinge sleeve. The end piece has a shoulder extending in the radial direction and which engages with a form fit in a groove in the interior space of the hinge sleeve.

The shoulder is integrally connected to the end piece and has a slight interference fit with respect to the groove in order to generate a form fit.

The shoulder and the complementary groove can have any shape, such as a polygon and an associated recess.

The outer surface of the rear and front ends of the shaft has a sawtooth profile which is laterally interrupted by the transverse groove. During the assembly of the friction hinge, the end piece is pressed onto the sawtooth profile in order to generate a form fit. For this purpose, the toothing is designed to be larger in diameter than the inner diameter of the end piece. The end piece can, for example, be made of plastics material or also of a zinc die-cast if very high friction is to be expected. Alternatively, the end piece can also be made from other materials. The inner surface of the end piece is preferably smooth, but it can also have an inner profile. All profile shapes in the connection region of the end piece and shaft serve to secure the shaft axially and against rotation.

Alternatively, a detachable connection, for example a screw connection, can also be used for axial securing.

In the interior space of the sleeve, there is a rib which, when the end piece is slipped onto the shaft, fits into the transverse groove and thus creates a non-rotatable connection. The rib is preferably arranged diagonally in the cross section of the end piece and protrudes into the interior space.

A groove-fork form fit is thus created in order to transmit the generated torque from the inner leaf to the outer leaf or vice versa.

Instead of a transverse groove, other profile shapes are also possible, which enter into a form-fitting connection with a profile within the end piece. In a kinematic reversal, provision can also be made for a rib to be arranged at the end of the shaft and for a groove into which the web engages within the end piece.

Complementary geometries are claimed, such as a polygon, which allow a form-fitting connection between the end piece and the shaft.

In the preferred embodiment, the spring is not coated, but a coating is possible in order to increase the friction.

The friction can be adjusted with the number of springs, with a higher number of friction springs also resulting in higher friction.

The ratio of friction depends on the coefficient of friction between the friction spring and the shaft and the number of friction springs.

The wrapped shaft can of course also be provided with a coating, which then increases the friction, if necessary, or else reduces the wear on the shaft.

A friction hinge which has the same friction in every direction can be realized if a plurality of friction springs is used, each of which is attached to its shoulder. Half of the friction springs is wrapped around the shaft in one direction and the other half is wrapped around the shaft in the opposite direction. A hinge arrangement with a different frictional torque for each direction of rotation can thus be created.

For example, one part of the friction springs can be mounted on the shaft starting with the shoulder and ending with the spring end, while the other part of the friction springs is arranged on the shaft starting with the spring end and ending with the shoulder. The arrangement of friction springs and shaft can thus be used bidirectionally in order to obtain the maximum torque for both directions of rotation of the friction hinge.

An asymmetrical frictional torque can be obtained if different numbers of identical friction springs are used in both directions. An asymmetrical frictional torque can also be obtained if other parameters are varied, such as the distance between the friction springs, without the need to provide friction springs with different characteristics.

A placeholder between the individual springs is also possible in order to reduce the friction.

The shaft is preferably made of a stainless steel, for example 1.4305 stainless steel, which is preferably plasma nitrided. Other steels with appropriate treatment are of course also suitable as shaft materials.

The surface of the shaft is preferably smooth. In another embodiment, the surface can also be coated or artificially roughened in order to increase friction.

In the case of the friction hinge according to the invention, a frictional connection is created in which no clearance occurs.

The present invention can provide a different torque for each direction.

In the friction hinge according to the invention, a friction or friction element is integrated into the hinge sleeves through the individual friction springs, i.e. in the immediate pivoting movement portion, via which, when the two hinge parts pivot relative to one another, a frictional resistance that damps the pivoting movement or opposes the pivoting movement is generated.

For this purpose, the individual friction springs are non-rotatably connected to one hinge sleeve of one hinge part and are friction-coupled to the other hinge part via the shaft, so that there is a frictional connection to the other hinge part. This frictional connection generates the frictional or damping resistance that is overcome by the pivoting movement.

The subject matter of the present invention results not only from the subject matter of the individual claims, but also from the combination of the individual claims with one another.

All information and features disclosed in the documents, including the abstract, in particular the spatial configuration shown in the drawings, could be claimed to be substantial to the invention insofar as they are novel over the prior art, individually or in combination. The use of the terms "substantial" or "according to the invention," or "substantial to the invention" is subjective and does not imply that the features named in this way must necessarily be part of one or more claims.

In the following, the invention is explained in more detail with reference to the drawings, which show a plurality of embodiments.

Further features and advantages of the invention that are substantial to the invention are clear from the drawings and its description.

In the drawings:

FIG. 1: is a front view of the hinge according to the invention

Figure 2:
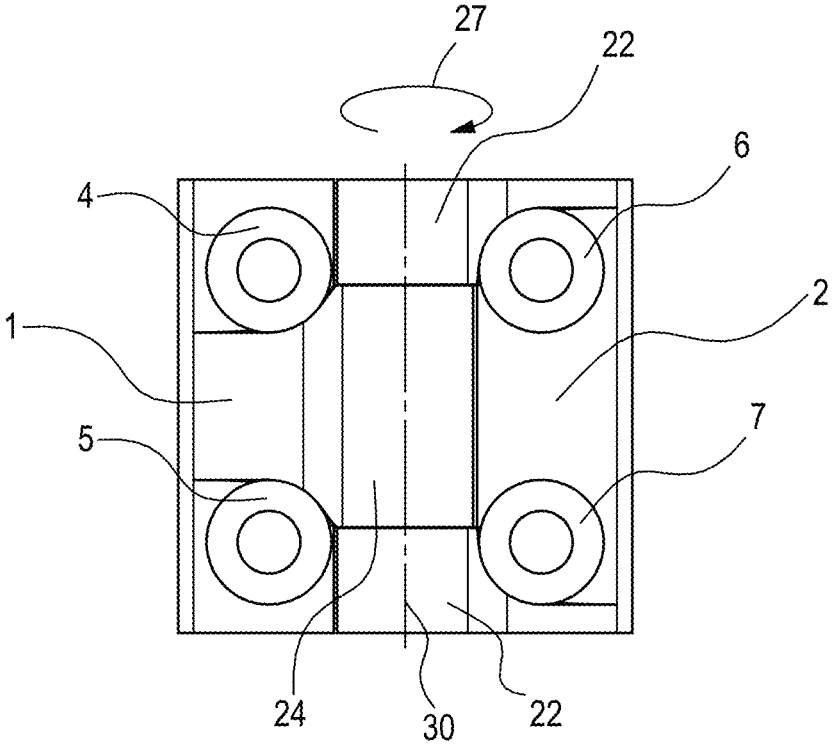

FIG. 2: is a plan view of the hinge according to the invention

Figure 3:
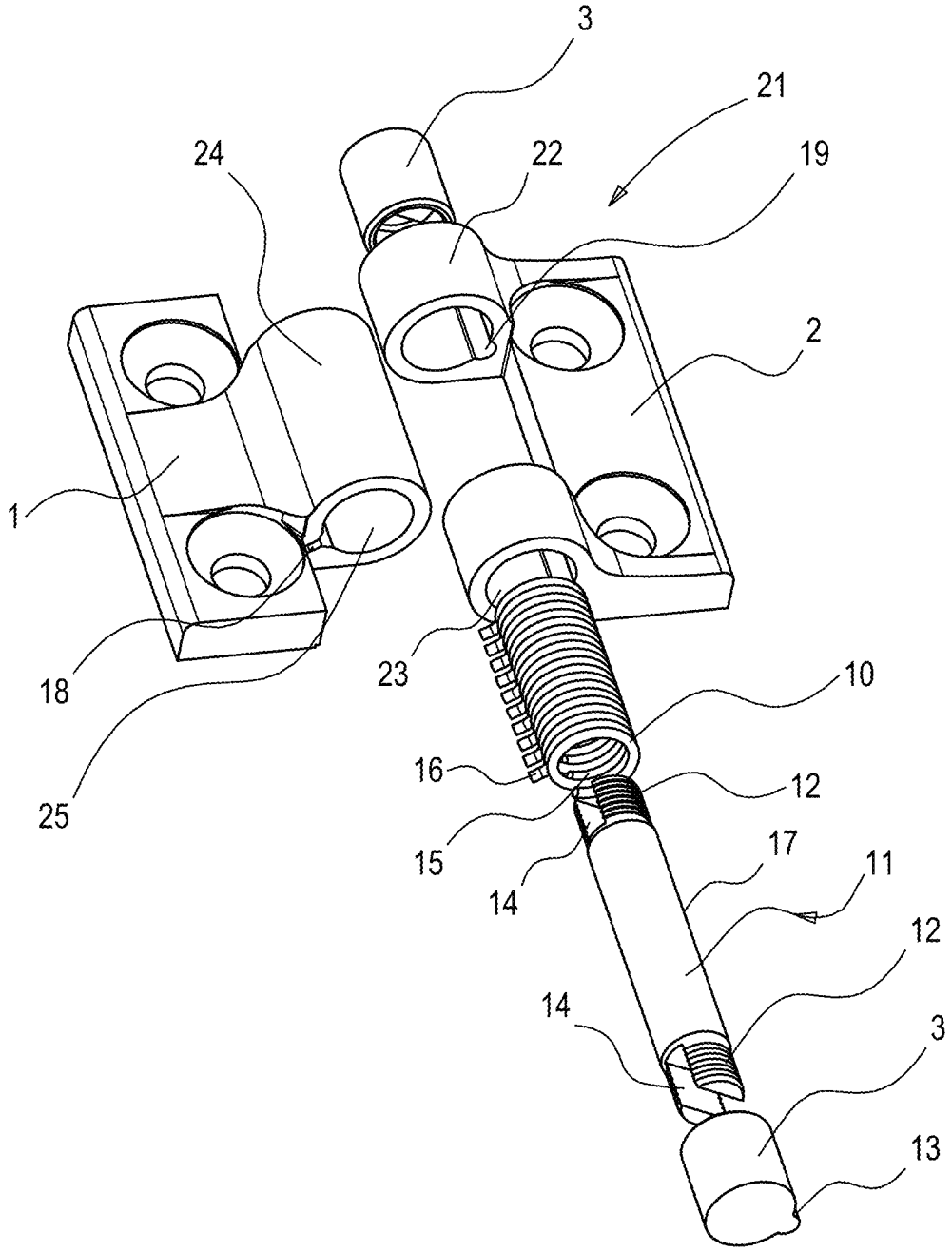
Figure 4:
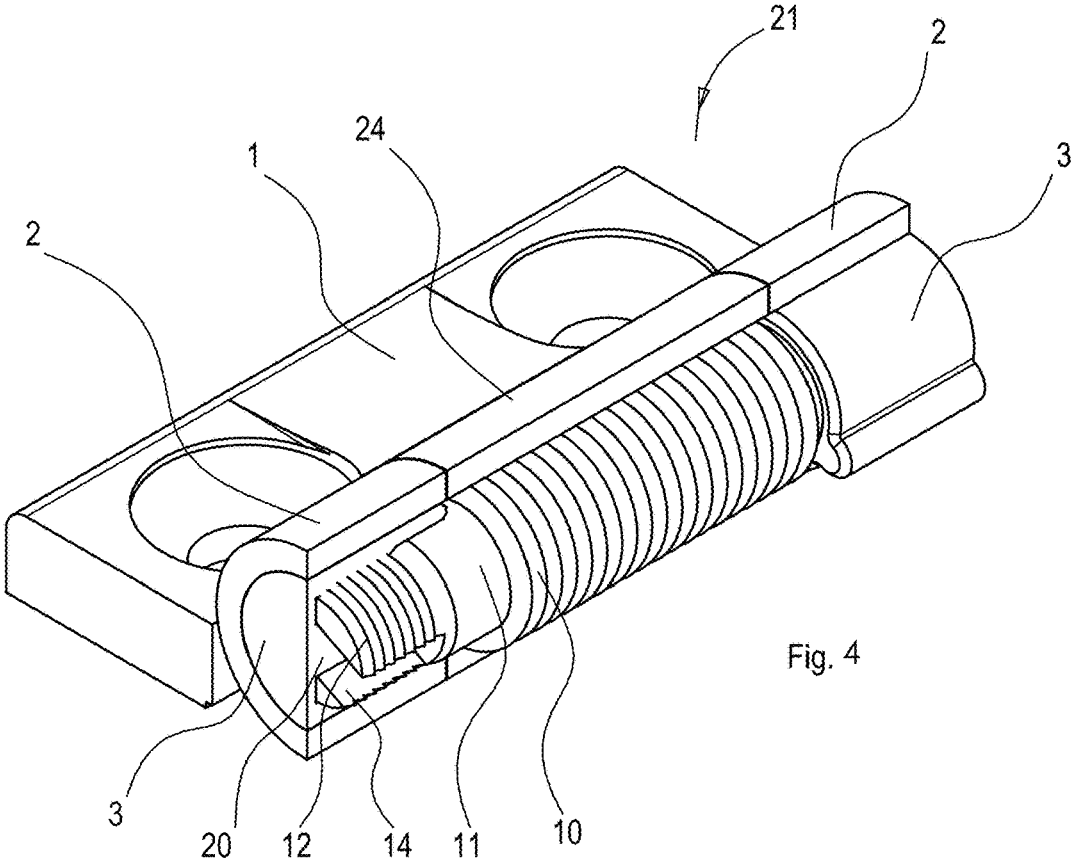
Figure 5:
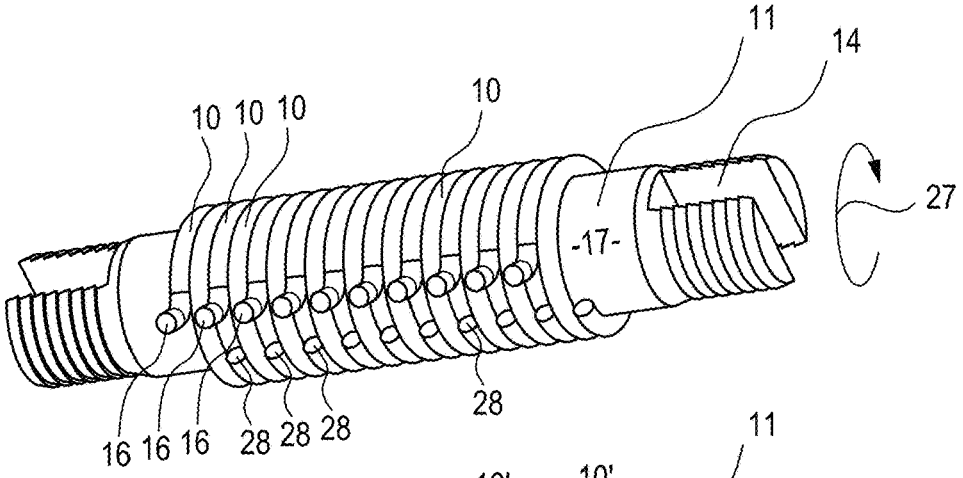
Figure 6:
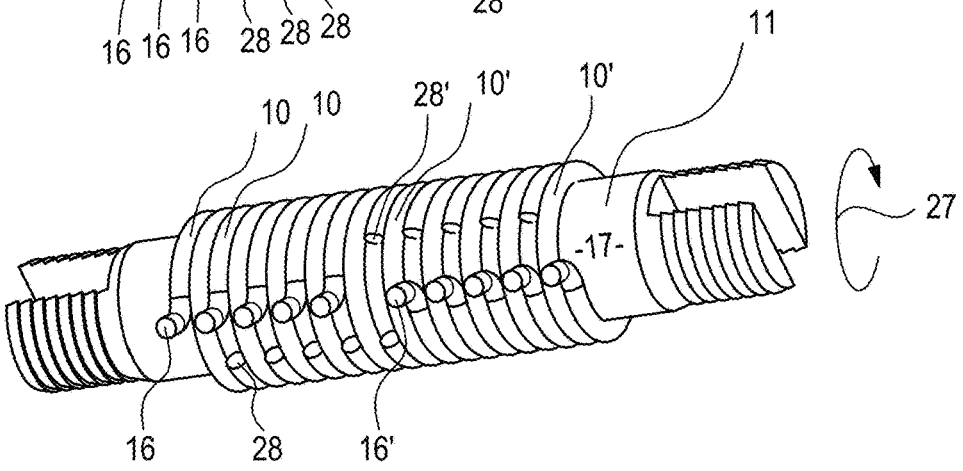
Figure 7:
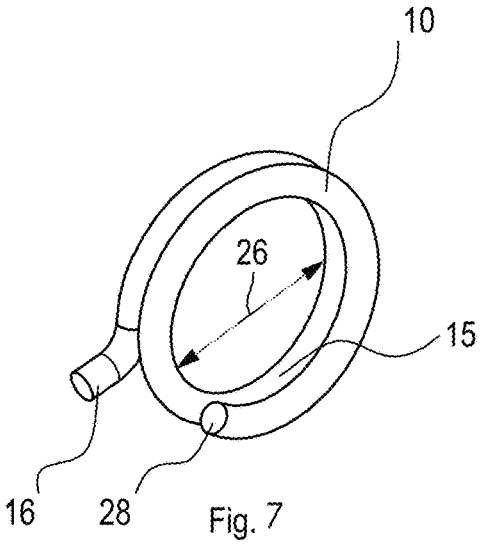
Figure 8:
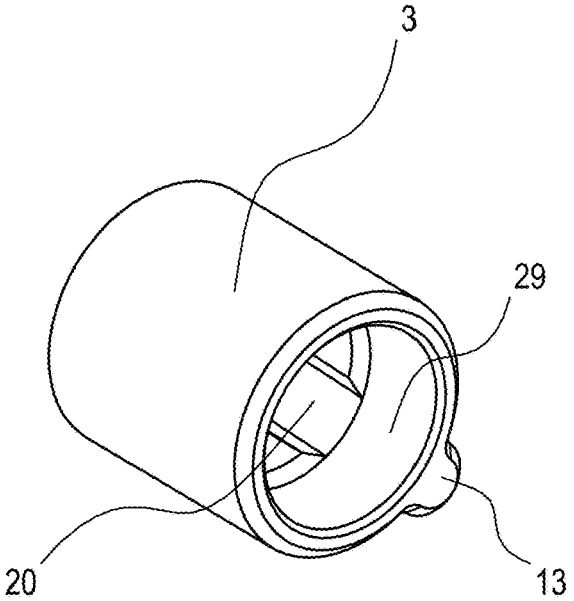
Figure 9:
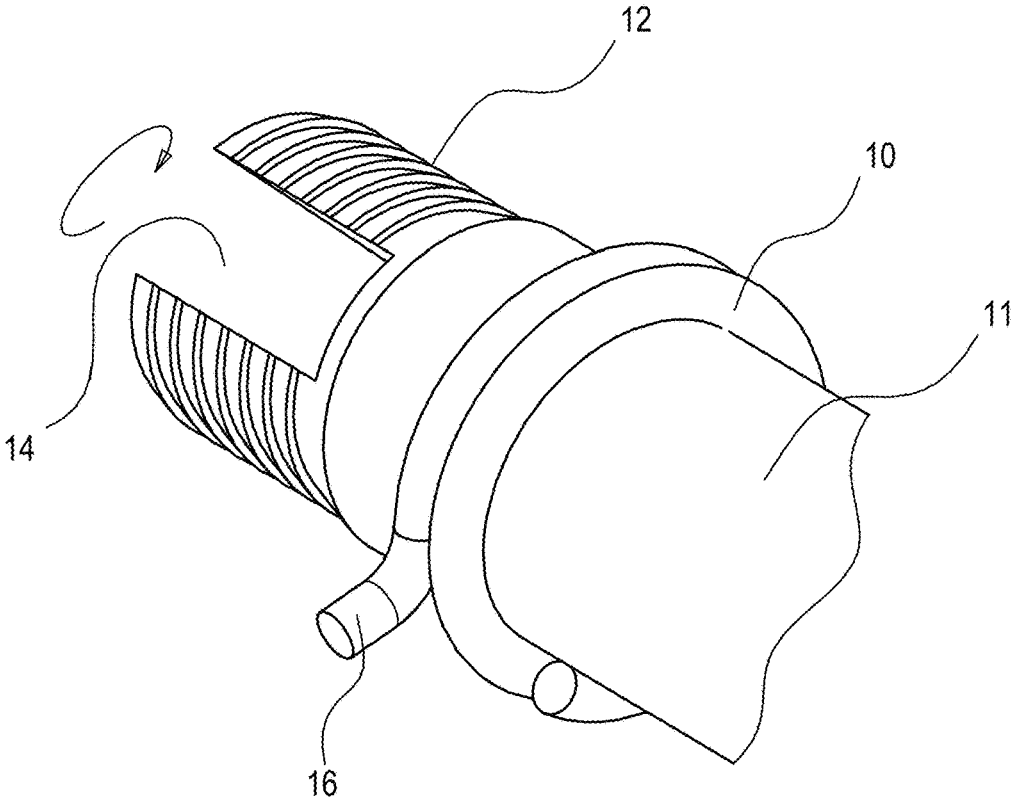
Figure 10:
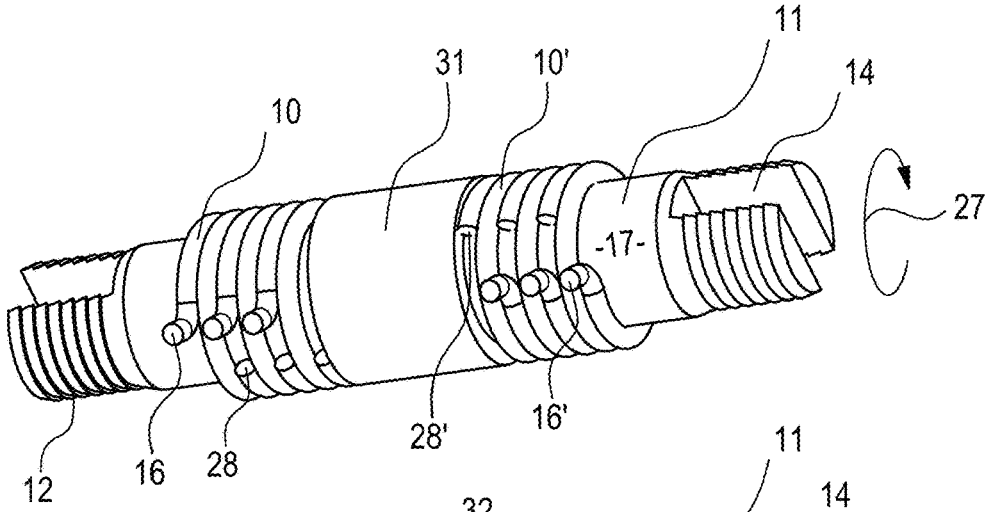
Figure 11:
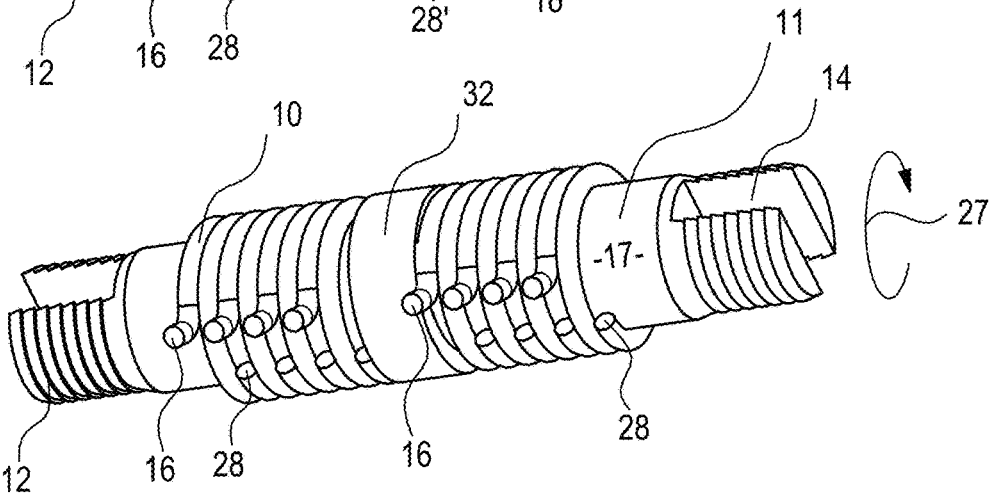
Figure 12:
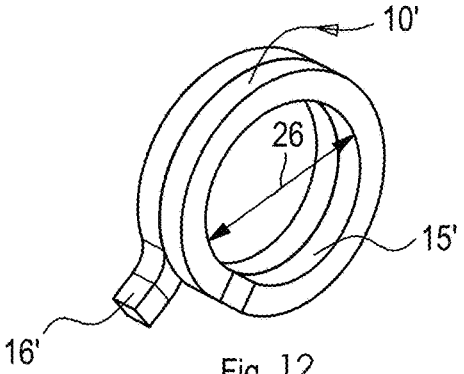
Figure 13:
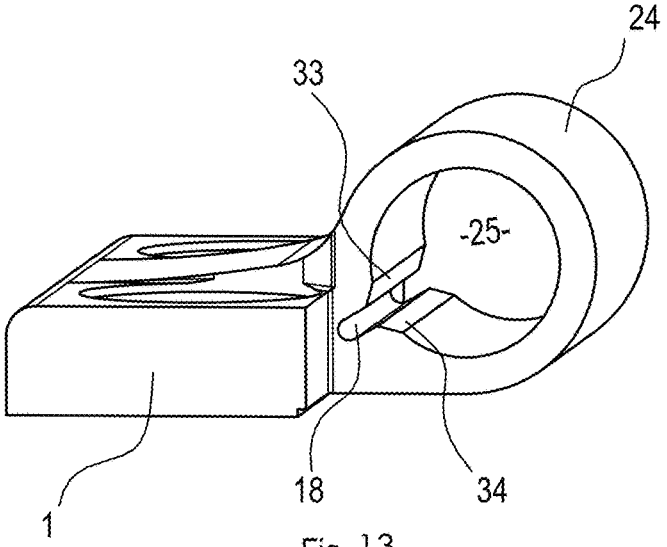

FIG. 3: is an exploded view of a first embodiment of a hinge according to the present invention FIG. 4: is a sectional illustration of a first embodiment of a hinge according to the present invention FIG. 5: is a perspective detailed view of the shaft with friction springs of a first embodiment of a hinge according to the present invention FIG. 6: is a perspective detailed view of the shaft with friction springs of a second embodiment of a hinge according to the present invention FIG. 7: is a detailed view of the friction spring FIG. 8: is a detailed view of the end piece FIG. 9: is a detailed view of the shaft end with friction spring and transverse groove FIG. 10: is a perspective detailed view of the shaft with friction springs of a third embodiment of a hinge according to the present invention FIG. 11: is a perspective detailed view of the shaft with friction springs of a fourth embodiment of a hinge according to the present invention FIG. 12: is a detailed view of the friction spring FIG. 13: is a detailed view of the hinge sleeve FIG. 1 is a front view of the friction hinge 21 according to the invention, which has two hinge leaves 1, 2 which are mounted so as to be pivotable with respect to one another. The axis of rotation 30, via which the left hinge leaf 1 can be pivoted with the right hinge leaf 2, is located in the center of the cylindrical hinge sleeves 22, 24 and runs through the shaft 11.

In FIG. 1, the front side of the shaft 11 is covered by the sleeve-shaped end piece 3, which is inserted into the interior space 23 of the hinge sleeve 22. The end piece 3 has a shoulder 13 which extends in the radial direction and which has a semicircular shape in cross section. This shoulder 13, which is designed in one piece with the end piece 13, engages with a form fit in a groove 19, also semicircular in cross section, which radially enlarges the interior space 23, which is otherwise circular in cross section, at one point.

The groove 19 is made in the hinge sleeve 22, the groove 19 being arranged at the four o'clock position in the example shown in FIG. 1.

The hinge leaf 1 has the support surface 8 and the hinge leaf 2 has the support surface 9, with which the friction hinge 21 can be mounted on different surfaces which are to be moved relative to one another.

FIG. 2 is the top view of the friction hinge 21 according to the invention, with the two hinge leaves 1, 2, which have the fastening bores 4-7, which make it possible to mount or screw the friction hinge with the bearing surfaces 8, 9 on surfaces.

The hinge leaf 2 has two hinge sleeves 22 which delimit an interior space 23 in which the shaft 11 shown in FIG. 3 is mounted. The hinge leaf 1 also has a hinge sleeve 24 with an interior space 25 in which the shaft 11 is mounted. The hinge sleeve 24 is arranged between the two hinge sleeves 22, the interior spaces 23, 25 being aligned with one another.

The axis of rotation 30, around which the hinge leaves 1, 2 of the friction hinge 21 can rotate, runs through the shaft mounted in the hinge sleeves 23, 25.

In the exploded view according to FIG. 3, the shaft 11 is shown, which has a transverse groove 14 each at its front and rear ends. This transverse groove 14 is a recess which starts from the front side of the shaft 11 and runs in the longitudinal direction and which has been milled or sawn into the front and rear ends of the shaft 11. The outer surfaces of the rear and front ends of the shaft 11 also have a sawtooth profile 12 which is laterally interrupted by the transverse groove 14.

The outer circumference 17, which is a smooth outer surface of the shaft 11, is located between the front and rear ends of the shaft, i.e. between the region where the transverse groove 14 and the sawtooth profile 12 are incorporated into the material of the shaft.

The individual friction springs 10 each define an opening with an inner diameter 26, the friction springs 10 arranged in series forming a common interior space due to the aligned openings. The shaft 11 can be inserted into this interior space.

In this case, the outer circumference 17 of the shaft 11 comes into contact with the friction surfaces 15 within the openings of the individual friction springs 10, a friction surface 15 representing the point of contact between the shaft 11 and a friction spring 10.

Each friction spring 10 has a shoulder 16 which extends from the otherwise circular friction spring in the radial direction.

This shoulder 16, or the shoulders 16 arranged in a row, are mounted in a longitudinal groove 18 within the hinge sleeve 24 when the friction hinge 21 is assembled. This longitudinal groove 18 extends in the longitudinal direction in the interior space 25 and is introduced into the inner circumferential surface of the interior space 25.

The front and rear ends of the shaft 11 are each covered by an end piece 3 which is inserted or pressed into the interior space 23 of the hinge sleeve 22. The end piece 3 has the shoulder 13 which, in the assembled state, fits with a form fit into the groove 19. This groove 19 extends in the longitudinal direction in the interior space 23 and is introduced into the inner circumferential surface of the interior space 23 of the hinge sleeve 22.

FIG. 4 shows a sectional view of the friction hinge 21 according to the invention in the assembled state. The interior space of the sleeve 3 has a rib 20 which is introduced into the transverse groove 14. Due to the rib 20 in the interior space of the sleeve 3 and the shoulder 13 on the outer circumference of the sleeve 3, the shaft 11 is secured in position in the hinge sleeve 22. In this case, the form-fitting engagement of the rib 20 in the transverse groove 14 and the form-fitting engagement of the shoulder 13 in the groove 19 prevent the shaft 11 from rotating within the hinge sleeve 22.

FIG. 5 shows the shaft 11 passed through the openings of the friction springs 10 arranged in series. In the unloaded state, the friction surfaces 15 of the individual springs 10 abut against the outer circumference 17 of the shaft 11. Each friction spring 10 has a shoulder 16 and a circular path which starts from this shoulder and ends in a spring end 18 after less than two turns.

Due to the offset between the shoulder 16 and the spring end 28, which is arranged less than two turns in the longitudinal direction next to and below the shoulder 16, it is possible to arrange the shoulder 16 of the subsequent friction spring 10 above the spring end 28, whereby the turns of this subsequent friction spring are flush with the coils of the previous friction spring.

If the hinge leaf 1, in the hinge sleeve 24 of which the shoulders 16 of the friction springs 10 are inserted with a form fit in the longitudinal groove 18, is now rotated in the direction of the arrow 27, the individual friction springs 10 are compressed and the inner diameter 26 of the friction springs 10 is reduced. The maximum configured friction is already set in the first angular minutes during the rotation and remains constant until the end position of the pivoting movement. There is no increase in friction as a function of the absolute angle.

According to FIG. 5, the friction springs are thus tied around the shaft in a rotary movement. Counter to the direction of rotation, the whole system runs freely and, with this free run, there is significantly less friction. The friction hinge thus has an increased frictional torque in one direction of movement in the direction of arrow 27 and a reduced frictional torque in the other direction of movement, in the opposite direction of arrow 27.

FIG. 6 shows a further embodiment in which only half of the spring assembly formed from individual friction springs 10 has the same orientation, in which each friction spring 10 starts with a shoulder 16' and ends with a spring end 28. From the center of the shaft 11, the following friction springs 10' are arranged upside down, so that each friction spring 10' starts with the spring end 28' and ends with the shoulder 16.

If the shaft is now actuated in the direction of rotation 27, the inner diameter 10 of the friction springs 10 arranged to the left of the center is reduced and the inner diameter of the friction springs 10' arranged to the right of the center increases. In this way, a friction can be exerted on the shaft 11 during an opening and closing movement of the hinge.

In the case of the mirror-inverted installation of half of the springs, the overall friction is reduced, but the same friction in both directions of rotation is obtained.

In FIG. 7, a single friction spring 10 is shown, which is bent from a round wire. Due to the round cross section of the turns, the friction surface 15 between the friction spring and the outer circumference 17 of the shaft 11 is relatively small and abuts tangentially against the outer circumference.

The individual friction springs 10 each define an opening with an inner diameter 26, the friction springs 10 arranged in series forming an interior space due to the aligned openings. The shaft 11 can be inserted into this interior space.

In the unloaded state, the friction spring has a diameter of 26 which, depending on the force acting, can be continuously reduced to a diameter of 26' or increased to a diameter of 26". The introduction of the reference signs 26', 26" is only used for the purpose of illustration, since no precise diameter can be defined due to the design and material, and it is only a matter of the effective friction between the friction spring 10 and the shaft 11.

FIG. 8 shows the end piece 3 with a rib 20 which is arranged diagonally in the cross section of the end piece 3 and projects into the interior space 29. This rib 20 is inserted into the transverse groove 14 of the shaft 11, as can be seen in FIG. 9. The sawtooth profile 12 of the shaft 11 comes into contact with the inner circumferential surface of the interior space 29 of the end piece 3 and prevents unintentional detachment of the end piece 3 from the shaft 11.

The end piece 3, which is connected to the groove 18 of the hinge sleeve 24 via the shoulder 13, prevents the shaft 11 from rotating due to the frictional force acting on the shaft by the friction spring 10 via the engagement of the rib 20 in the transverse groove 14.

FIGS. 10 and 11 each show an embodiment in which a spacer sleeve 31, 32 is arranged between a left pair of friction springs and a right pair of friction springs, through which the shaft 11 is also guided. According to FIG. 10, analogous to FIG. 6, the right-hand friction spring pair, formed by the lined up friction springs 10 is arranged in a mirror-inverted manner with respect to the left-hand friction spring pair, formed by the lined up friction springs 10' and start with the spring end 28'.

According to FIG. 11, analogous to FIG. 5, the left and right friction spring pairs are aligned in the same way, but the spacer sleeve 32 is designed to be narrower than the spacer sleeve 31 of FIG. 10.

FIG. 12 shows an embodiment of a friction spring 10' which is bent from a wire with an angular cross section. Due to the square cross section of the turns, the friction surface 15' between the friction spring and the outer circumference 17 of the shaft 11 is made relatively large and lies flat on the outer circumference.

FIG. 13 shows the interior space 25 of the hinge leaf 1, in the inner circumferential surface of which a longitudinal groove 18 extends in the longitudinal direction. The longitudinal groove 18 is delimited by a chamfer 33, 34 at its transition to the cylindrical inner circumferential surface, which chamfer also extends in the longitudinal direction. These two-sided chamfers 33, 34 allow the friction spring to be installed regardless of the orientation of the shoulder 16. Thus, the chamfer 33 is used for installing the friction spring starting with the shoulder and ending with the spring end (clockwise), and the chamfer 34 is used for installing the friction spring starting with the spring end and ending with the shoulder (counterclockwise). The chamfers 33, 34 serve as an insertion aid.

LIST OF REFERENCE SIGNS

1. Hinge leaf
2. Hinge leaf
3. End piece
4. Fastening bore
5. Fastening bore
6. Fastening bore
7. Fastening bore
8. Support surface
9. Support surface
10. Friction spring 10'
11. Shaft
12. Sawtooth profile
13. Shoulder
14. Transverse groove
15. Friction surface 15'
16. Shoulder 16'
17. Outer circumference
18. Longitudinal groove
19. Groove
20. Rib
21. Friction hinge
22. Hinge sleeve
23. Interior space (of 21)
24. Hinge sleeve
25. Interior space (of 24)
26. Inner diameter (of 10) 26', 26"
27. Direction of rotation
28. Spring end 28'

29. Interior space (of 3)
30. Axis of rotation
31. Spacer sleeve
32. Spacer sleeve
33. Chamfer
34. Chamfer

The invention claimed is:

1. A friction hinge for the pivotable connection of two components, comprising:

at least one first hinge sleeve, at least one second hinge sleeve which is arranged in alignment with the at least one first hinge sleeve, a shaft rotatably mounted about a longitudinal axis of the shaft through the at least one first and second hinge sleeves, at least two mutually aligned friction springs for exerting a friction torque on the rotatably mounted shaft, each of the at least two mutually aligned friction springs comprising a first radial spring end, a second radial spring end, and a radial shoulder extending from the first end and being connected to the at least one first hinge sleeve, each of the at least two mutually aligned friction springs exerting a friction torque on the shaft mounted in the at least one second hinge sleeve, a sleeve-shaped end piece covering the shaft on a front side, the sleeve-shaped end piece being inserted into an interior space of the at least one second hinge sleeve, the sleeve-shaped end piece having a shoulder extending in a radial direction and engaging with a form fit in a groove in the interior space of the at least one second hinge sleeve, wherein the shaft has first and second ends, each of which has a transverse groove, and wherein a rib is arranged in the interior space of the end piece and is introduced into the transverse groove when the friction hinge is assembled.

2. The friction hinge according to claim 1, wherein the at least one first and second friction springs consist of a bent spring wire with at least one and at most two turns.

3. The friction hinge according to claim 2, wherein the bent spring wire defines a circular opening through which the shaft is passed and, within the circular opening, the at least one first and second friction spring comprising friction surfaces in frictional contact with an outer circumference of the shaft.

4. The friction hinge according to claim 1, wherein each of the at least one first and second friction springs have the radial shoulder made of one piece of material and extending in a radial direction.

5. The friction hinge according to claim 4, wherein the radial shoulder is mounted in a longitudinal groove inside the at least one first hinge sleeve which extends in a longitudinal direction of the at least one first hinge sleeve and is introduced into an inner circumferential surface of the interior space.

6. The friction hinge according to claim 1, wherein an outer surface of the first and second ends of the shaft has a sawtooth profile which is laterally interrupted by the transverse groove.

7. The friction hinge according to claim 1, wherein at least one first friction spring of the at least two mutually aligned friction springs is installed in a mirror-inverted manner with respect to at least one second friction spring of the at least two mutually aligned friction springs.

8. The friction hinge according to claim 7, wherein the at least one first friction spring is supported only by the first radial spring end engaged in a longitudinal groove of the at least one first hinge sleeve designed as a stop surface and the second spring end abuts against the shaft with a friction fit and is carried along by the shaft.

9. The friction hinge according to claim 1, wherein the at least two mutually aligned friction springs have no mutual coupling.

10. The friction hinge according to claim 1, wherein the at least two mutually aligned friction springs are installed into the hinge either in a concealed or open manner.

11. The friction hinge according to claim 1, wherein rotation of the shaft about the longitudinal axis results in a maximum configured friction of the at least two mutually aligned friction springs that remains constant until an end position of the rotational movement.

12. A friction hinge for the pivotable connection of two components, comprising:

at least one first hinge sleeve, at least one second hinge sleeve which is arranged in alignment with at least one first hinge sleeve, a shaft rotatably mounted through the hinge sleeves, at least two mutually aligned friction springs for exerting a friction torque on the rotatably mounted shaft, each of the at least two mutually aligned friction springs comprising a first end, a second end, and a radial shoulder extending from the first end and being connected to the at least one first hinge sleeve, each of the at least two mutually aligned friction springs exerting a friction torque on the shaft mounted in the at least one second hinge sleeve, wherein the shaft has first and second ends and each of the first and second ends have a transverse groove.

13. The fiction hinge according to claim 12, further comprising a sleeve-shaped end piece covering the shaft on a front side inserted into an interior space of the at least one second hinge sleeve, the sleeve-shaped end piece having a shoulder extending in a radial direction and engaging with a form fit in a groove in the interior space of the at least one second hinge sleeve.

14. The friction hinge according to claim 13, wherein a rib is arranged in an interior space of the sleeve-shaped end piece and is introduced into the transverse groove when the friction hinge is assembled.

* * * * *